US005998744A

United States Patent [19]

Osborn

[11] Patent Number: 5,998,744

[45] Date of Patent: Dec. 7, 1999

[54] POWER OUTLET WITH SAFETY INTERLOCK

[75] Inventor: Robert H. Osborn, Collierville, Tenn.

[73] Assignee: Thomas & Betts International, Inc. (DE), Sparks, Nev.

[21] Appl. No.: 09/170,368

[22] Filed: Oct. 12, 1998

[51] Int. Cl.[6] ..... H01H 9/20

[52] U.S. Cl. ..... 200/50.28; 200/51.09; 200/50 B

[58] Field of Search ..... 200/50.28–50.31, 200/50.09, 51 R, 51.17

[56] References Cited

U.S. PATENT DOCUMENTS

| | | | |
|---|---|---|---|
| 1,689,495 | 10/1928 | McElroy . | |
| 1,731,417 | 10/1929 | Hartwig . | |
| 1,971,990 | 8/1934 | Reynolds et al. . | |
| 2,015,543 | 9/1935 | Bissell | 200/50 |
| 2,420,865 | 5/1947 | Conlan | 200/50 |
| 3,370,141 | 2/1968 | Garamszegi | 200/115.5 |
| 3,598,941 | 8/1971 | Nelson | 200/51.09 |
| 4,335,286 | 6/1982 | Nelson | 200/302 |
| 4,414,440 | 11/1983 | Decoste | 200/50 |
| 4,521,649 | 6/1985 | Nelson | 200/50 |
| 4,604,505 | 8/1986 | Henniger | 200/50 |
| 4,635,690 | 1/1987 | Knecht et al. | 200/51.09 |

*Primary Examiner*—Michael L. Gellner
*Assistant Examiner*—Nhung Nguyen
*Attorney, Agent, or Firm*—G. Andrew Barger

[57] ABSTRACT

A power outlet that has a moveable ground pin disposed in a receptacle and has a normal position with the pin extended and an inserted position. An actuator arm with a projection member is coupled to the ground pin and a rotational cam stop abuts the projection member. A pushrod is included that has a shaft, a lever member coupled to the shaft, and a notch for receiving at least part of the cam stop therein. A circuit breaker is disposed in the outlet and has a switch with an OFF position, and an ON position for activating the circuit breaker. The switch is coupled to the lever member. When the ground pin is actuated into the inserted position, the projection member slides away from the receptacle, rotating the cam stop such that it is clear of the notch and the pushrod thereby is enabled to throw the switch from the OFF position to the ON position. The actuator arm spring independently returns the ground pin to the normal position when the pin is removed from the receptacle and works in conjunction with the pushrod spring to throw the switch of the circuit breaker from the ON position to the OFF position if the pin is removed with the circuit breaker switch in the ON position such that the ground pin is returned to the normal position.

10 Claims, 5 Drawing Sheets

POWER OUTLET WITH SAFETY INTERLOCK

FIELD OF THE INVENTION

In general, the present invention relates to outlets and, in particular, the present invention relates to a power outlet with a safety interlock.

BACKGROUND

For a number of years power outlets with safety interlocks have been used in shipping yards for providing power to refrigerated devices on shipping docks. In operation, when a pin from a device is inserted into a receptacle of one of these outlets, no power is provided to the device until a safety interlock is deactivated, which enables a circuit break thereby allowing the device to receive power.

Typical power outlets with safety interlocks use one large spring to return both the ground pin and pushrod to their normal positions when a pin is withdrawn from the receptacle. This design makes pin insertion very difficult because of the great force needed to insert a pin that requires forcing a ground pin inward, which is highly tensioned. Still other power outlets use one spring for the ground pin and another spring to serve in pushrod return, but the springs do not work in conjunction to return the pushrod to its normal position when a pin is removed with the circuit breaker activated. Thus, a large spring is required to provide tension on the push rod, making it difficult to push inward to activate the circuit breaker. Typical power outlets also use a complicated system of push rods, levers, pulleys, springs, and cams to provide a safety interlock. These complex designs are labor intensive and do not lend themselves to simple field servicing.

Typical power outlets also do not have a cam stop for providing the safety interlock that prevents the pushrod from actuating the circuit breaker while a pin is uninstalled in the receptacle. Further, because a cam stop is not supplied in current designs, no cam stops are rotated by inward movement of the ground pin when the pin is installed in the receptacle to enable the circuit break to be activated.

SUMMARY OF THE INVENTION

The present invention eliminates the above difficulties and disadvantages by providing a power outlet that has a moveable ground pin disposed in a receptacle having a normal position with the ground pin extended. An actuator arm with a projection member is coupled to the ground pin and a rotational cam stop abuts the projection member. A pushrod is included that has a shaft, a lever member coupled to the shaft, and a notch for receiving at least part of the cam stop therein. An actuator arm spring is coupled between the actuator arm and a stationary tab. A circuit breaker is disposed in the outlet and has a switch with an OFF position, and an ON position for activating the circuit breaker. The switch is coupled to the lever member. A further advantage is that a pushrod spring partially surrounds the shaft of the pushrod and is coupled between the retention pin and the abutment member.

When the plug is actuated into the receptacle, the projection member and ground pin slides away from the receptacle, rotating the cam stop such that it is clear of the notch and the pushrod thereby is enabled to throw the switch from the OFF position to the ON position. The actuator arm spring independently returns the ground pin to the normal position when the pin is removed from the receptacle and works in conjunction with the pushrod spring to throw the switch of the circuit breaker from the ON position to the OFF position if the pin is removed with the circuit breaker switch in the ON position.

Another advantage of the present invention is that an abutment member is disposed in the outlet and has the stationary tab formed therewith and is in contact with the face plate. A retention pin is disposed in the shaft, and a nob is spaced from the lever member and coupled to the shaft. The pushrod spring is tensioned against the abutment member.

DETAILED DESCRIPTION OF THE PREFERRED EMBODIMENTS

Figure 1:
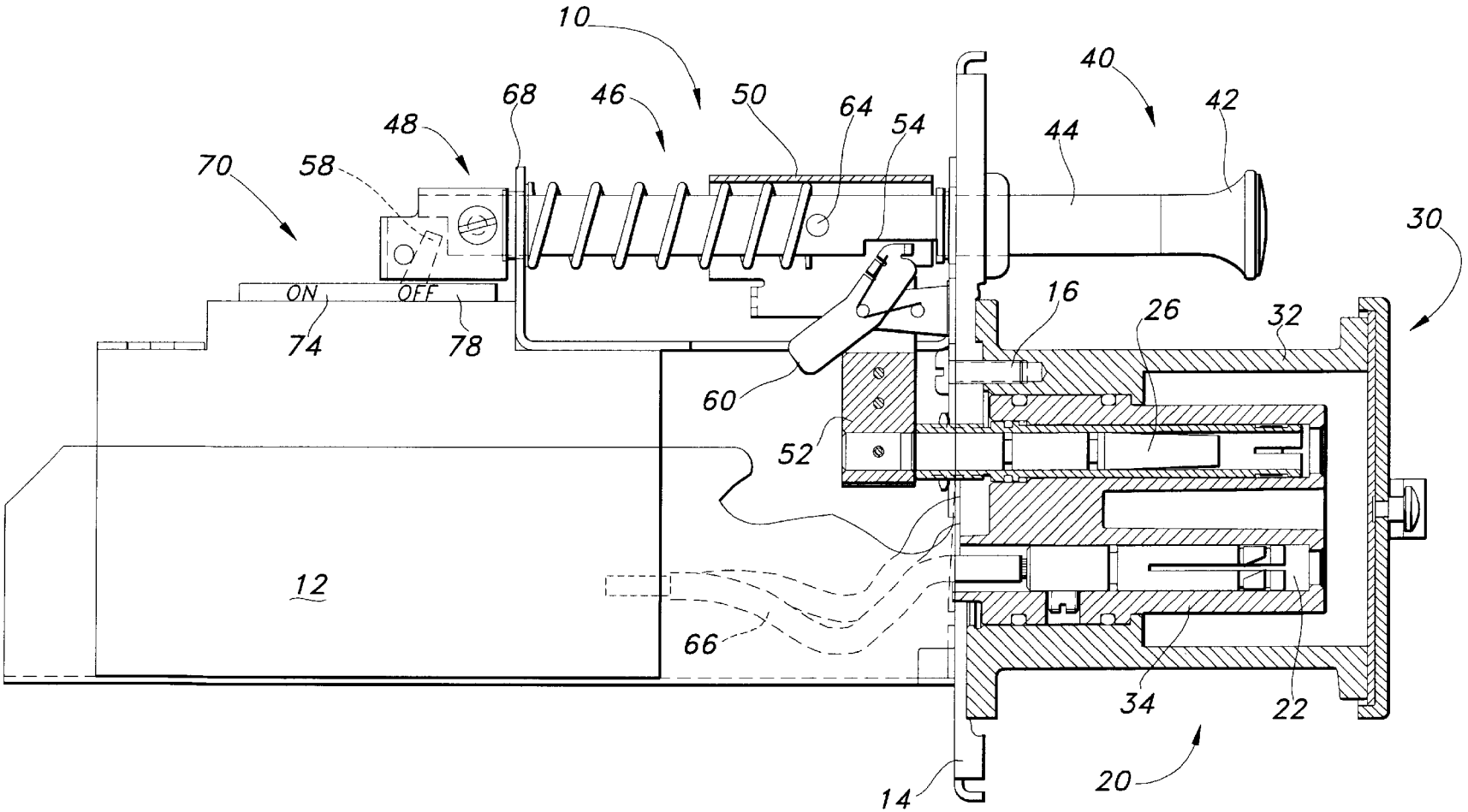
FIG. 1 is a side elevational view and partial cut-away view showing a stop cam disposed within a notch of a pushrod and a ground pin in a normal position of the present invention.

The above and other features, aspects, and advantages of the present invention will now be discussed in the following detailed description and appended claims, which are to be considered in conjunction with the accompanying drawings in which identical reference characters designate like elements throughout the views.

Shown in FIG. 1 is a power outlet 10 that is partially enclosed in a bounded side wall 12, which is abutted by a face plate 14. A receptacle 20 is provided in the power outlet 10 that is secured to the face plate 14 by a plurality of screws 16 and is preferably manufactured by the Thomas & Betts Corporation having a principal place of business at: 8155 T&B Boulevard, Memphis, Tenn. 38125. The receptacle 20 has an annular exterior portion 32 into which the plurality of screws 16 are inserted after being attached to the face plate 14. The exterior portion 32 is preferably constructed from a non-corrosive metal such as aluminum or thermoplastic material. Surrounded by the exterior portion 32 is an annular interior portion 34 having a plurality of ports 22 for receiving an electrical pin therein. The receptacle 20 preferably includes four ports 22 with one being grounded and containing a ground pin 26, as will be discussed in greater detail below. The remaining ports 22 provide three-phase, AC power to an electrical device such as a refrigerated container at a shipping yard. Internal conductors 66 couples the ports 22 and a circuit breaker 70 of the present invention. The interior portion 34 of the receptacle 20 is preferably constructed of a thermoplastic or thermoset insulator. Covering the receptacle 20 is a cap 30 that is also constructed of a non-corrosive metal such as stainless steel or thermoplastic material and which seals the ports 22 from environmental elements, including water, salt, and dirt when the receptacle 20 is not in use such as at the shipping yard. The cap 30 is also preferably constructed by the Thomas & Betts Corporation. Its address is listed previously.

Figure 4:
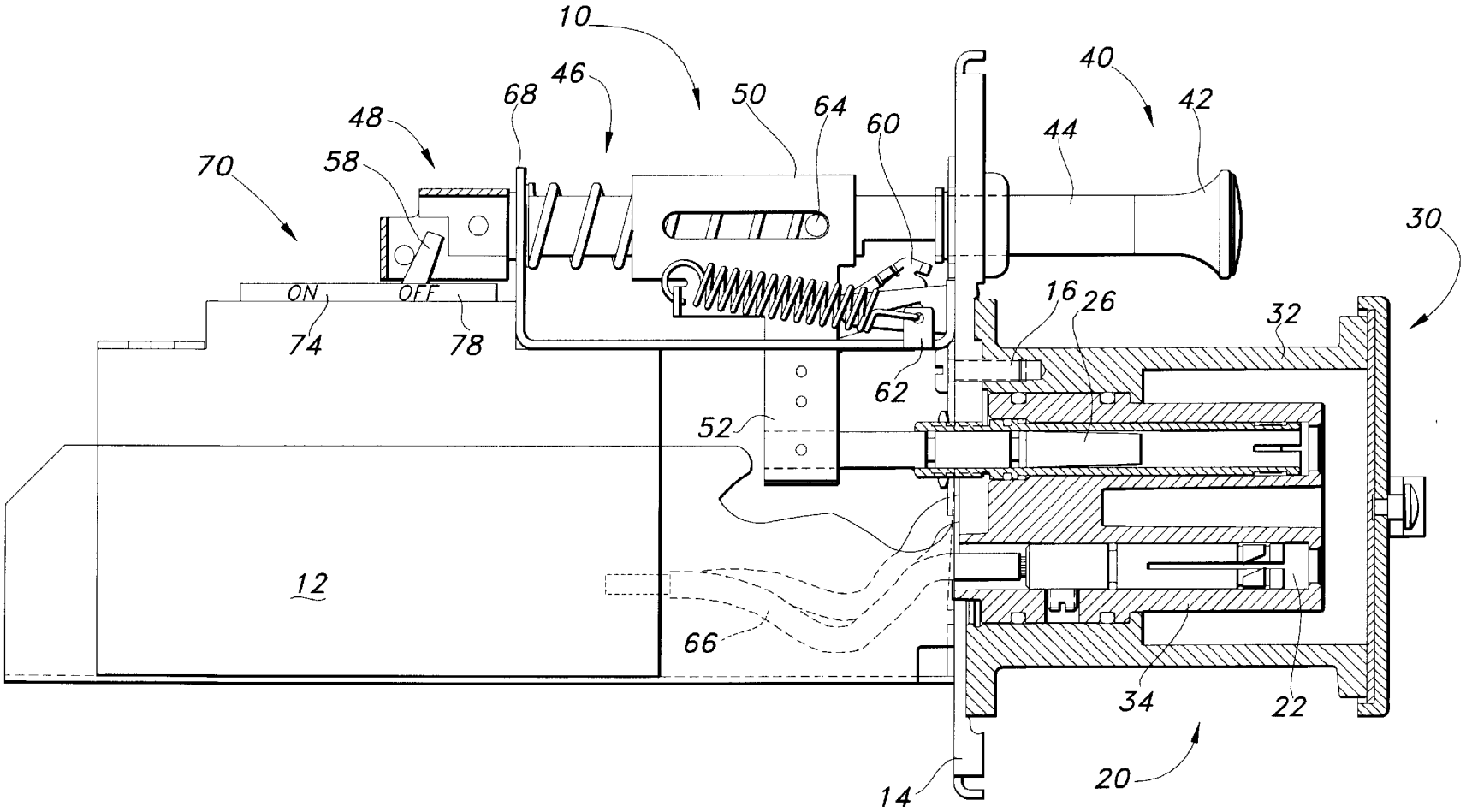
FIG. 4 is a side elevational view and partial cut-away view showing a tensioned actuator arm spring, stop cam rotated from within the slot, and the ground pin in an inserted position with a circuit breaker in the OFF position of the present invention.
Figure 5:
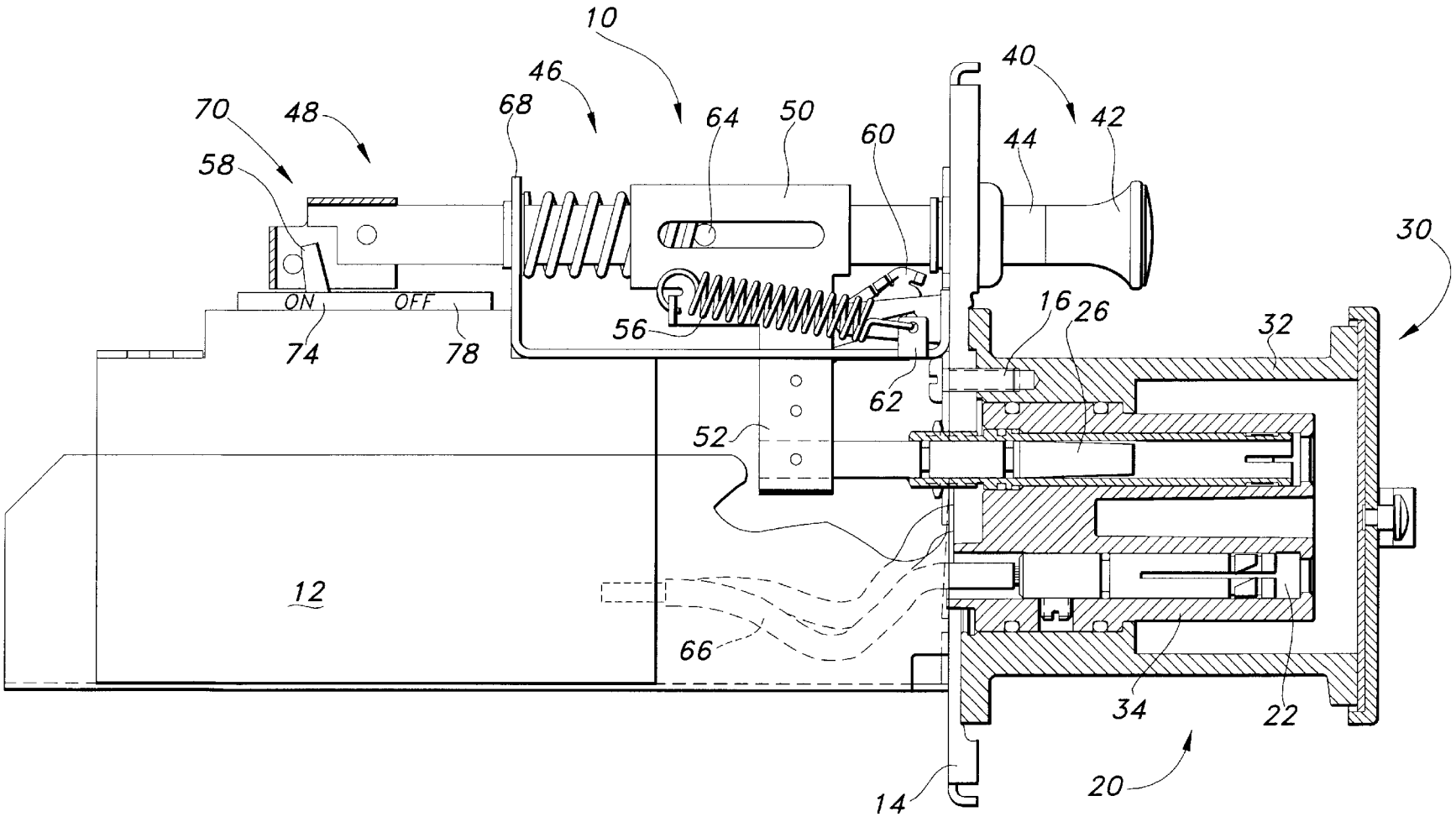
FIG. 5 is a side elevational view and partial cut-away view showing a tensioned actuator arm spring, stop cam rotated from within the slot, and the ground pin in an inserted position with a circuit breaker in the ON position of the present invention.

As mentioned above, a moveable ground pin 26 is disposed and slidably contained in one of the plurality of ports 22 and is also preferably constructed by the Thomas & Betts Corporation. The ground pin 26 has a normal position with the pin 64 extended and an inserted position when a prong of the pin is inserted into the receptacle 20, as best shown in FIGS. 4 and 5.

Figure 2:
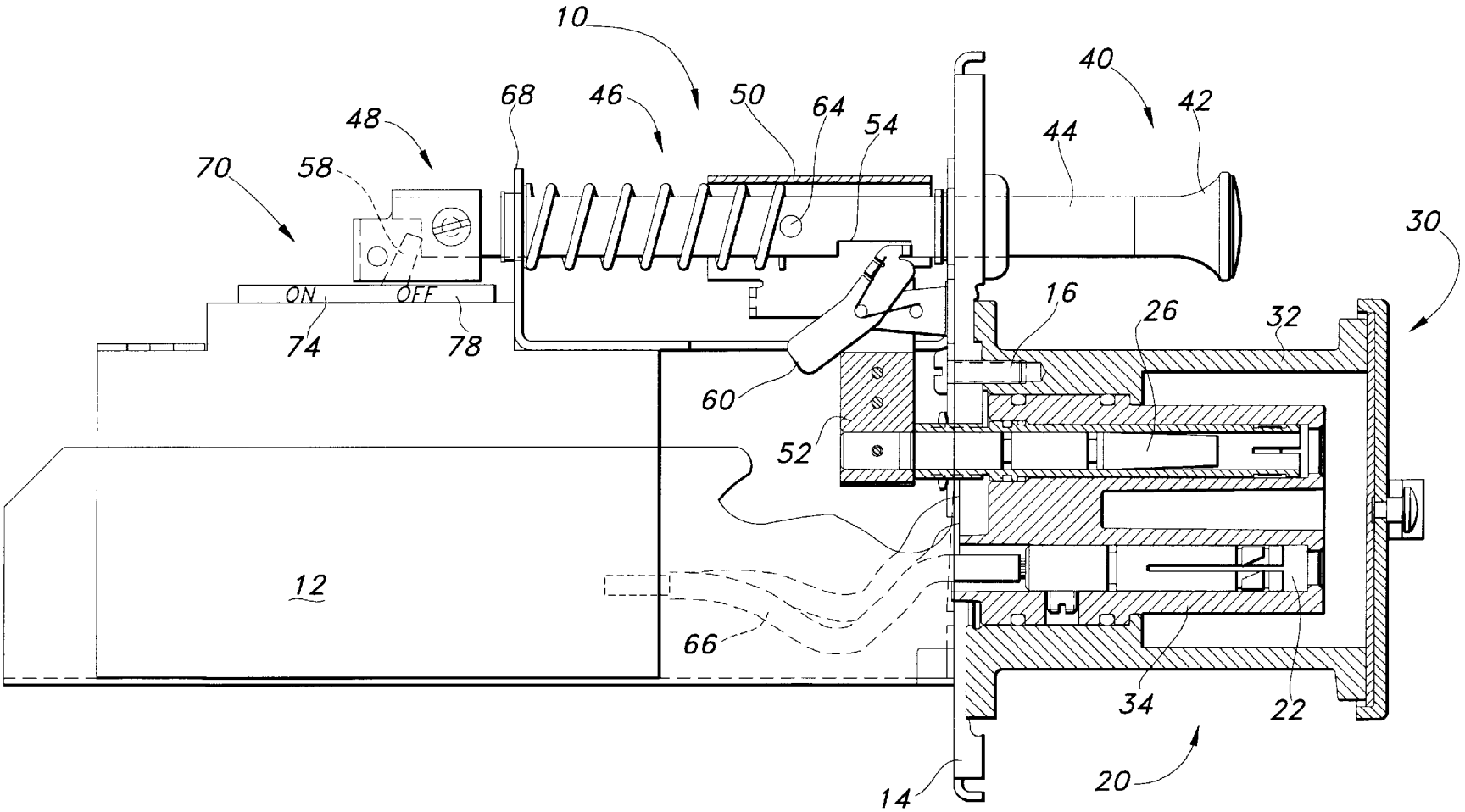
FIG. 2 is a side elevational view and partial cut-away view showing the stop cam abutting the notch of the pushrod and the pushrod partially inserted of the present invention.
Figure 3:
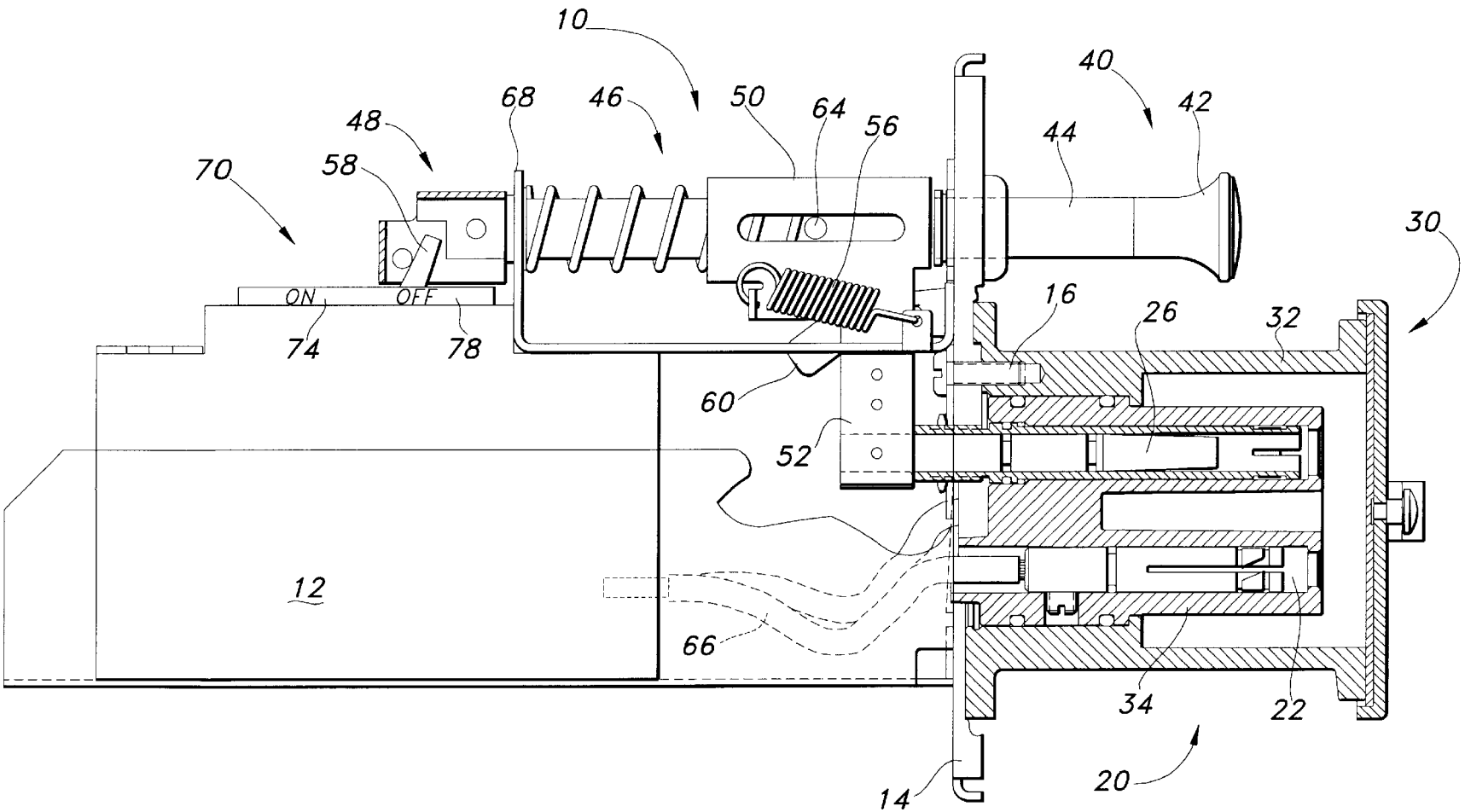
FIG. 3 is a side elevational view and partial cut-away view showing a ground pin in a normal position and an actuator arm spring in an untensioned position of the present invention.

A projection member 52 is coupled to the ground pin 26 and is generally orthogonal thereto. The projection member 52 is secured to an actuator arm 50, which, in turn, is generally orthogonal to the projection member 52, parallel to the ground pin 26 and is also preferably constructed by the Thomas & Betts Corporation. As shown in FIGS. 3, 4, and 5, an actuator arm spring 56 is coupled between the actuator arm 50 and a stationary tab 62 that is formed on a stationary abutment member 68, which is in contact with the face plate 14. As shown in FIGS. 1 and 2, a rotational cam stop 60 abuts the projection member 52 and its operation, in conjunction with the projection member 52, ground pin 26, and an actuator arm spring 56 will be discussed below.

The actuator arm 50 partially surrounds a cylindrical pushrod 40 that has a shaft 44 insertable into the outlet 10 and is also preferably constructed by the Thomas & Betts Corporation. A lever member 48 is coupled to the shaft 44 at one end and a nob 42 is provided at the other end, spaced from the lever member 48, and coupled to the shaft 44 for allowing an operator to push the pushrod 40 into the outlet 10. Further, a retention pin 64 is disposed in the shaft 44, and a notch 54 for receiving at least part of the cam stop 60 therein to provide the safety interlock of the present invention and its operation will be discussed below.

A circuit breaker 70 is disposed in the outlet 10 and is preferably manufactured by the Square D Company with a distribution address at: 3700 Sixth Street SW, P.O. Box 3069, Cedar Rapids, Iowa 52406 and under Part No. GJL36030, but could also be another circuit breaker depending upon the particular application for the outlet 10. The circuit breaker 70 has a switch 58 with an OFF position 78, and an ON position 74, representing a first state and a second state, for activating the circuit breaker 70. The switch 58 is coupled to the lever member 48 and is preferably housed at least partially within the lever member 48. In addition, a pushrod spring 46 surrounds at least part of the shaft 44 of the pushrod 40 and is coupled between the retention pin 64 and the abutment member 68.

Operation of the present power outlet 10 will now be described with particular reference to the drawings. Shown in FIG. 1 is the cam stop 60 disposed within the notch 54 of the pushrod 40 and the ground pin 26 in a normal position. With the cam stop 60 projecting into the notch 54, the pushrod 40 cannot be pushed to change the switch 58 of the circuit breaker 70 from the OFF position 78 to the ON position 74. Thus, power cannot be sent to the receptacle 20 of the power outlet 10 in this state. This is further demonstrated in FIG. 2 where it is shown that the cam stop 60 when within the notch 54 prevents the partially inserted pushrod 40 from activating the circuit breaker 70 by changing the switch 58 from the OFF position 78 to the ON position 74. FIG. 3 is the same as FIG. 1 except it shows the actuator arm spring 56 in an untensioned position disposed between the actuator arm 50 and tab 62.

Once the pin is inserted into the receptacle 20, the ground pin 26 is slide further into the receptacle 20 thereby causing the attached projection member 52 to move toward the circuit breaker 70, as shown in FIG. 4. During this movement, the projection member 52 rotates the abutting cam stop 60 in the clockwise direction such that the cam stop 60 rotates out from within the notch 54 in the shaft 44 of the pushrod 40 and the actuator arm spring 56 becomes tensioned. Once the cam stop 60 is clear of the notch 54 (i.e., the safety interlock is disabled), the pushrod 40 may be pushed at the nob 42 by an operator to throw the switch 58 from the OFF position 78 to the ON position 74. This ensures that the circuit breaker 70 can only be activated when the pin is fully inserted into the receptacle 20. The compression force of the pushrod spring 46 is preferably greater than the force of tension for the actuator arm spring 56 such that insertion of the pin into the receptacle 20 requires a small amount of force and pushing the rod 40 inward to change the circuit breaker switch 58 from the OFF position 78 to the ON position 74 requires a relatively much greater force. During insertion of the pin and pushing inward of the pushrod 40, the actuator arm spring 56 and pushrod spring 46, respectively, act independently of each other.

Shown in FIG. 5 is a tensioned actuator arm spring 56 and a compressed pushrod spring 46. Also a pin 64 is shown inserted at least partially through the shaft 44 and that is in contact with the pushrod spring 46 such that the spring 46 is forced against the abutment member 68 when the switch 58 is in the ON position 74 and a return tensional force is created. As long as the pin remains inserted in the receptacle 20, and the switch 58 is in the ON position, the pushrod spring 46 and actuator arm spring 56 will remain in their tensioned and compressed positions.

Once the pin is removed from the receptacle 20, the actuator arm spring 56 independently returns the ground pin 26 to the normal position and works in conjunction with the pushrod spring 46 to throw the switch 58 of the circuit breaker 70 from the ON position 74 to the OFF position 78 if the pin is removed with the circuit breaker switch 58 in the ON position 74. This coupling provides a quick disabling of the circuit breaker 70 and the tensioned force of the actuator arm spring 56 aids the compression force of the pushrod spring 46 to change the switch 58 from the ON position 74 to the OFF position 78.

Although the invention has been described in detail above, it is expressly understood that it will be apparent to persons skilled in the relevant art that the invention may be modified without departing from the spirit of the invention. Various changes of form, design, or arrangement may be made to the invention without departing from the spirit and scope of the invention. Therefore, the above mentioned description is to be considered exemplary, rather than limiting, and the true scope of the invention is that defined in the following claims.

What is claimed is:

1. A power outlet having a face plate and a receptacle with a plurality of ports for receiving an electrical pin therein, the power outlet comprising:

a moveable ground pin disposed in one of the plurality of ports;

an actuator arm with a projection member coupled to the ground pin;

an abutment member having a stationary tab formed therewith and being in contact with the face plate;

an actuator arm spring coupled between the actuator arm and the stationary tab;

a rotational cam stop abutting the projection member;

a pushrod having a shaft, a lever member coupled to the shaft, and a notch for receiving at least part of the cam stop therein;

a retention pin disposed in the shaft, and a nob spaced from the lever member and coupled to the shaft;

a pushrod spring partially surrounding the shaft of the pushrod and coupled between the retention pin and the abutment member;

a circuit breaker disposed in the outlet and having a switch coupled to the lever member; and wherein when the ground pin is actuated, the projection member and the cam stop move thereby enabling movement of the switch and wherein the actuator arm spring works in conjunction with the pushrod spring to throw the switch of the circuit breaker from the first state to the second state.

2. The power outlet of claim 1 wherein the actuator arm spring independently moves the ground pin when the electrical pin is removed from the receptacle.

3. A power outlet having a face plate, and a receptacle with a plurality of ports for receiving an electrical pin therein, the power outlet comprising:

an abutment member having a stationary tab formed therewith and being in contact with the face plate;

a moveable ground pin disposed in one of the plurality of ports and having a normal position with the pin extended into the receptacle and an inserted position;

an actuator arm with a projection member coupled to the ground pin and generally orthogonal thereto;

an actuator arm spring coupled between the actuator arm and a stationary tab of the outlet;

a pushrod having a shaft, a lever member coupled to the shaft, a retention pin disposed in the shaft, and a nob spaced from the lever member and coupled to the shaft;

a circuit breaker disposed in the outlet and having a switch with an OFF position, and an ON position for activating the circuit breaker, the switch being coupled to the lever member;

a pushrod spring partially surrounding the shaft of the pushrod and coupled between the retention pin and the abutment member; and wherein the actuator arm spring works in conjunction with the pushrod spring to throw the switch of the circuit breaker from the ON position to the OFF position if the ground pin is returned to the normal position with the circuit breaker switch in the ON position.

4. The power outlet of claim 3 further comprising a rotational cam stop abutting the projection member.

5. The power outlet of claim 4 wherein the pushrod further includes a notch for receiving at least part of the cam stop therein.

6. The power outlet of claim 5 wherein when the ground pin is actuated into the inserted position, the projection member slides away from the receptacle, rotating the cam stop such that it is clear of the notch, and the pushrod thereby is enabled to throw the switch from the OFF position to the ON position.

7. The power outlet of claim 3 wherein the switch is housed within the lever member.

8. The power outlet of claim 3 wherein the actuator arm spring independently returns the ground pin to the normal position from the inserted position.

9. A power outlet having a face plate, and a receptacle with a plurality of ports for receiving an electrical pin therein, the power outlet comprising:

an abutment member in contact with the face plate;

a moveable ground pin disposed in one of the plurality of ports and having a normal position with the pin extended into the receptacle and an inserted position;

an actuator arm with a projection member coupled to the ground pin and generally orthogonal thereto;

a rotational cam stop abutting the projection member;

an actuator arm spring coupled between the actuator arm and a stationary tab of the outlet;

a pushrod having a shaft, a lever member coupled to the shaft, a retention pin disposed in the shaft, a nob spaced from the lever member and coupled to the shaft, and a notch for receiving at least part of the cam stop therein;

a circuit breaker disposed in the outlet and having a switch with an OFF position, and an ON position for activating the circuit breaker, the switch being coupled to the lever member;

a pushrod spring partially surrounding the shaft of the pushrod and coupled between the retention pin and the abutment member; and wherein when the ground pin is actuated into the inserted position, the projection member slides away from the receptacle, rotating the cam stop in the clockwise direction such that it is clear of the notch, and the pushrod thereby is enabled to throw the switch from the OFF position to the ON position, and the actuator arm spring independently returns the ground pin to the normal position and works in conjunction with the pushrod spring to throw the switch of the circuit breaker from the ON position to the OFF position if the ground pin is returned to the normal position with the circuit breaker switch in the ON position.

10. The power outlet of claim 9 wherein the switch of the circuit breaker is housed within the lever member.

* * * * *